US010183327B2

(12) United States Patent
Spychala et al.

(10) Patent No.: US 10,183,327 B2
(45) Date of Patent: Jan. 22, 2019

(54) CASTING ASSEMBLY

(71) Applicant: Martinrea Honsel Germany GmbH, Meschede (DE)

(72) Inventors: Hans-Jürgen Spychala, Meschede (DE); Thomas Fulde, Schmallenberg (DE)

(73) Assignee: Martinrea Honsel Germany GmbH, Meschede (DE)

( * ) Notice: Subject to any disclaimer, the term of this patent is extended or adjusted under 35 U.S.C. 154(b) by 0 days.

(21) Appl. No.: 15/183,818

(22) Filed: Jun. 16, 2016

(65) Prior Publication Data

US 2017/0021411 A1 Jan. 26, 2017

(30) Foreign Application Priority Data

Jun. 24, 2015 (DE) ..... 10 2015 110 133

(51) Int. Cl.
*B22D 17/22* (2006.01)
*B22D 29/00* (2006.01)

(52) U.S. Cl.
CPC ..... *B22D 17/2236* (2013.01); *B22D 29/00* (2013.01)

(58) Field of Classification Search
CPC ..... B22C 9/062; B22C 9/064; B22D 17/2236; B22D 17/002; B22D 17/229; B22D 17/24
See application file for complete search history.

(56) References Cited

U.S. PATENT DOCUMENTS 6,216,766 B1 * 4/2001 Benni ..... B21F 27/125 164/119

FOREIGN PATENT DOCUMENTS

| | | | | |
|---|---|---|---|---|
| DE | 10 2013 102 569 A1 | | 9/2014 | |
| JP | 60009567 A | * | 1/1985 | ..... B22C 9/064 |
| JP | 61007044 A | * | 1/1986 | |
| JP | 2005205437 A | * | 8/2005 | ..... B22C 9/06 |

* cited by examiner

*Primary Examiner* — Kevin E Yoon
*Assistant Examiner* — Jacky Yuen
(74) *Attorney, Agent, or Firm* — Gudrun E. Huckett

(57) ABSTRACT

A casting mold of a casting assembly is openable in first and second release directions different from each other. The casting mold has a first base plate transverse to the first release direction and an opposite second base plate. First mold parts on first base plate and second mold parts on second base plate define first and second casting cavities. First and second lateral parts are arranged between first and second base plates. A third mold part on the first lateral part defines the first casting cavity. A fourth mold part on the second lateral part defines the second casting cavity. A fifth mold part on first base plate defines the first and second casting cavities. The first and second lateral parts are movable in second release direction. The first mold parts are moveably supported on guides of first base plate extending in second release direction.

6 Claims, 3 Drawing Sheets

CASTING ASSEMBLY

CROSS-REFERENCE TO RELATED APPLICATIONS

This application claims a priority date of 24 Jun. 2015, based on prior filed German patent application No. 10 2015 110 133.5, the entire contents of the aforesaid German patent application being incorporated herein by reference.

BACKGROUND OF THE INVENTION

The invention concerns a casting assembly comprising a casting mold enclosing at least two casting cavities for casting a cast part each; the casting mold can be opened in a first release direction and in at least one second release direction different from the first release direction.

Casting assemblies employing a casting mold which is to be opened in a first release direction and in at least one second release direction that is different from the first release direction are known. Such casting molds comprise in particular:

- a first base plate which is arranged transverse to the first release direction and on which first mold parts that determine the configuration of the casting cavities are supported,
- a second base plate which is arranged on the opposite side of the casting cavities and on which second mold parts that determine the configuration of the casting cavities are supported,
- lateral parts arranged between the two base plates, wherein, on a first lateral part, a third mold part that determines the configuration of the first casting cavity is supported and, on a second lateral part, a fourth mold part that determines the configuration of the second casting cavity is supported, and
- a fifth mold part which determines the configuration of both casting cavities and which is fastened to the first base plate between the two casting cavities.

The object of the invention is to improve for a casting assembly, comprising a casting mold that encloses at least two casting cavities for casting a cast part each, the destruction-free release action with the goal of casting even relatively complex casting parts.

SUMMARY OF THE INVENTION

As a solution to this object, a casting assembly of the aforementioned kind in accordance with the invention is characterized in that the lateral parts are arranged to be movable in the second release direction, in that the first mold parts are supported each on guides which are formed on the first base plate and extend in the second release direction, and in that the first mold parts are arranged to be movable along the guides.

In this casting assembly, the lateral parts are arranged so as to be moveable in the second release direction; furthermore, the first mold parts are supported on guides, respectively, which are formed on the first base plate and which extend in the second release direction, wherein the first mold parts are arranged to be movable along the guides.

With this casting assembly, a high degree of releasability on all sides is achieved so that even cast parts of a complex configuration can be cast without having to destroy individual mold parts for the purpose of release after casting. The casting assembly is suitable therefore in a special way for larger series production without the requirement of having to newly manufacture individual mold parts, for example, of solidified molding sand.

Casting can be performed with a three-plate tool as well as with an injection piston and a shot chamber as well as with a two-plate mold tool, i.e., with two parallel and simultaneously operating injection pistons and two shot chambers.

In one configuration of the casting assembly, it is proposed that the guides are oriented in the same direction and preferably aligned relative to each other.

In another embodiment, stops on the first base plate are proposed which delimit the movability of the first mold parts in the direction toward each other.

In a further embodiment, it is proposed that the first mold parts each comprise a mold section, which determines the configuration of the respective casting cavity, and a support section wherein only the support section is supported on the guide.

According to further embodiment of the casting assembly, the guide extends to a point behind the fifth mold part wherein a portion of the support section is located between the guide and the fifth mold part.

BRIEF DESCRIPTION OF THE DRAWINGS

Further advantages and details result from the following description of two embodiments. In the drawings, the casting mold and of the individual release steps of the employed release process.

DESCRIPTION OF PREFERRED EMBODIMENTS

Figure 1:
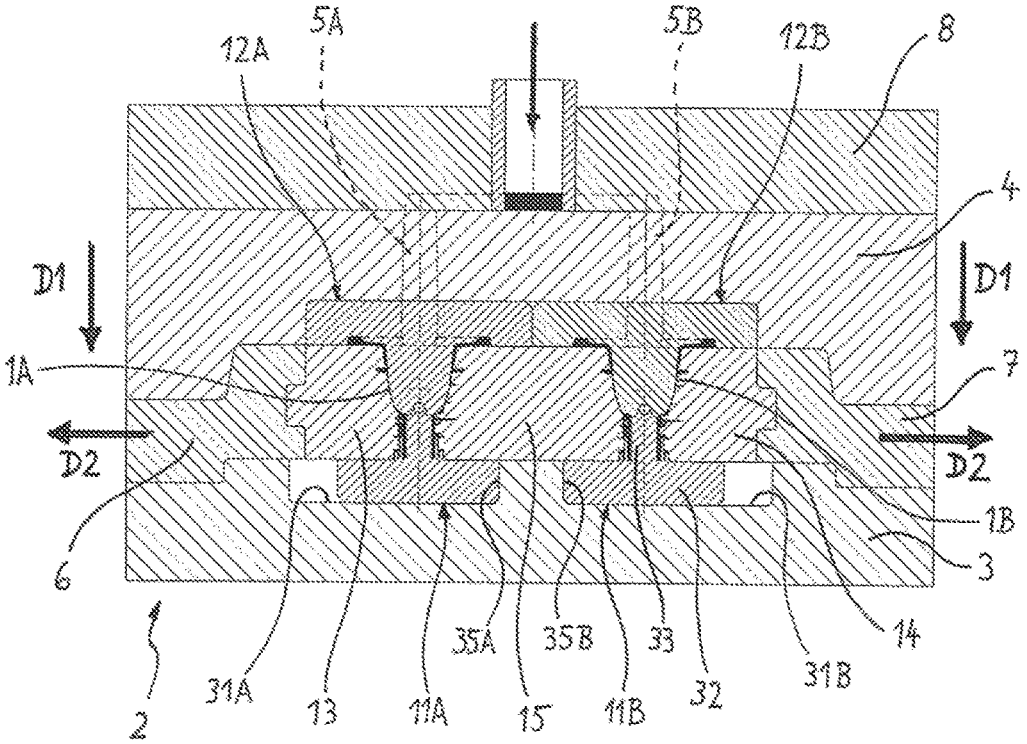
FIG. 1 shows a horizontal section of the casting mold which encloses two casting cavities for casting a cast part each, wherein the casting mold is illustrated after casting and prior to release.

FIG. 1 shows in a horizontal section the casting assembly in a first embodiment. The casting mold 2 of this casting assembly comprises in its interior two casting cavities 1A, 1B, i.e., hollow spaces, for casting a cast part, respectively. FIG. 1 shows the situation after casting. Therefore, the two cavities 1A, 1B are already completely filled with liquid metal, for example, a melt of an aluminum alloy, a magnesium alloy or a zinc alloy.

The casting assembly according to FIG. 1 is a so-called three-plate tool with plates 8, 4, and 3. For filling in the metal melt, a central casting chamber 5 which is formed in a stationary plate 8 of the casting assembly is provided; from the casting chamber, a first channel 5A extends through a base plate 4 of the casting mold to the first hollow space 1A and a second channel 5B extends through the base plate 4 to the second hollow space 1B. The channels 5A, 5B are indicated in FIG. 1 in dashed lines and also in FIG. 3 in regard to the second embodiment. In the other FIGS. 2 and 4 through 7, the channels are not illustrated.

After the two cast parts have cooled down sufficiently, the casting mold 2 is opened stepwise and in this way the cast parts are released, which is done in individual steps. In FIG. 1, for this purpose a first horizontal release direction D1 and a second release direction D2 different from the first release direction D1 are indicated. Preferably, the second release direction D2 extends transversely or at a right angle to the first release direction D1.

A component of the casting mold is a first base plate 3 which is extending transverse to the first release direction D1 and against which the first mold parts 11A, 11B determining the casting cavities 1A, 1B are supported in release direction D1. A second base plate 4 serves herein as an intermediate plate of the casting assembly and is supported against the stationary plate 8.

The second mold parts 12A, 12B determining the configuration of the casting cavities 1A, 1B are supported in the release direction D1 against the second base plate 4 (intermediate plate).

Lateral parts 6, 7 which are arranged between the base plates 3, 4 are also a component of the casting mold 2. In this context, a third mold part 13 which determines the configuration of the first casting cavity 1A is supported on the first lateral part 6. A fourth mold part 14 determining the configuration of the second casting cavity 1B is supported on the second lateral part 7.

The lateral parts 6, 7 are movably guided on the first base plate 3 in the second release direction D2 in order to be able to open, after solidification of the melt, the casting mold in lateral direction, i.e., in the direction of the second release direction D2. Mold parts 13 or 14 determining the shape of the casting are fastened to the lateral parts 6, 7.

A central component of the casting assembly is a fifth mold part 15 determining the shape of both casting cavities 1A, 1B. The fifth mold part 15 is attached to the first base plate 3 such that it is located between the two casting cavities 1A, 1B and that it determines the shape of both of the casting cavities 1A, 1B.

Figure 4:
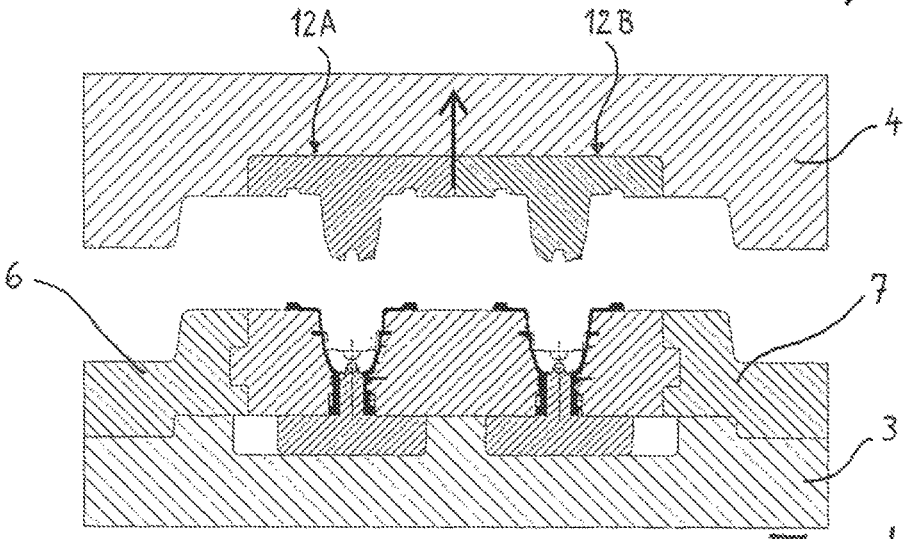
FIG. 4 shows the casting mold according to FIG. 2 after a first opening or release step.
Figure 5:
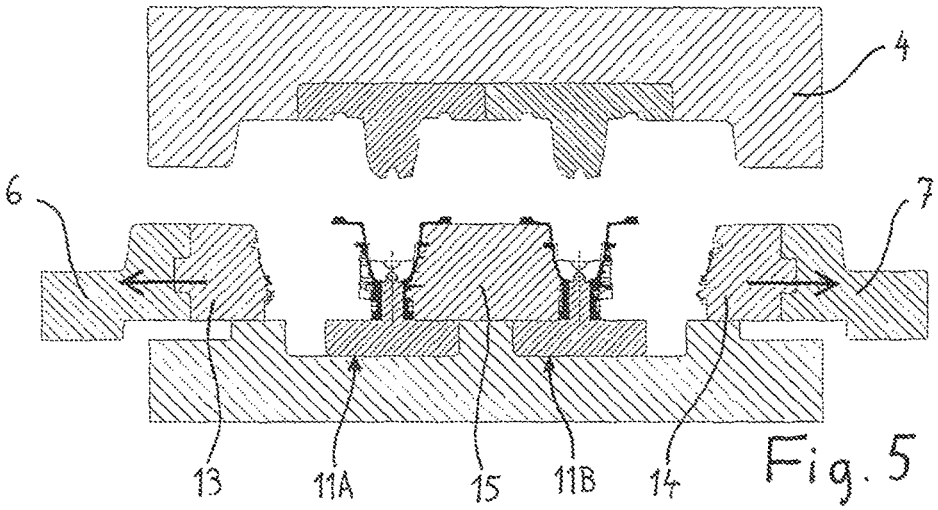
FIG. 5 shows the casting mold according to FIG. 2 after a second opening or release step.

The lateral parts 6, 7 with the mold parts 13, 14 are movably guided in the second release direction D2 along the first base plate 3, which is apparent when comparing the release step according to FIG. 4 and the release step of FIG. 5.

The first mold parts 11A, 11B are supported each on guides 31A, 31B which are formed on the first base plate 3 and which extend transversely to the direction of the first release direction D1. Along these guides 31A, 31B the first mold parts 11A, 11B are therefore movable in longitudinal direction, as is apparent when comparing FIG. 5 and FIG. 6.

Preferably, the left guide 31A is arranged oriented in the same direction and aligned with the right guide 31B. Stops 35A, 35B on the lower base plate 3 delimit the movability of the first mold parts 11A, 11B in a direction toward each other.

The first mold parts 11A, 11B are comprised each of a mold section 33 which also determines the configuration of the respective casting cavity 1A, 1B and of a support section 32. Only the support section 32 is supported so as to be slidable on the respective guide 31A, 31B. The mold section 33 on the other hand determines the mold space of the casting cavity.

Figure 6:
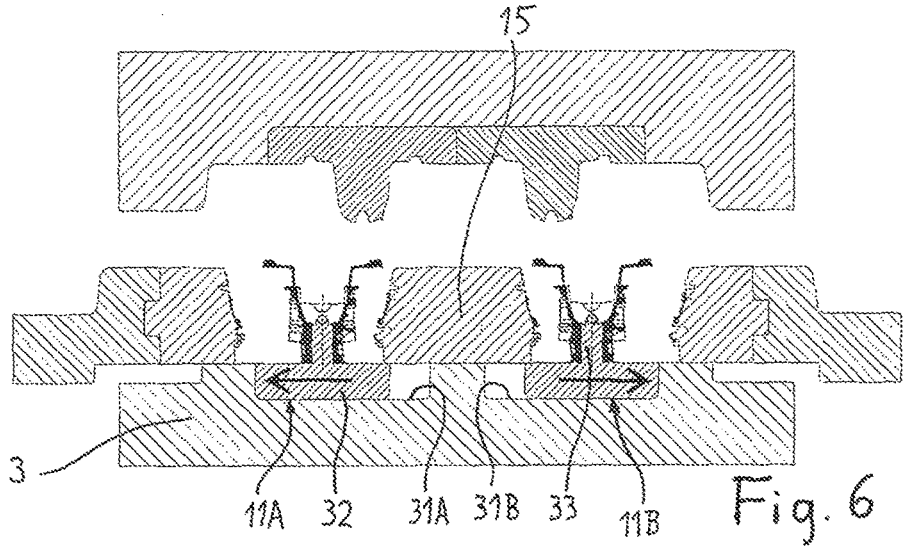
FIG. 6 shows the casting mold according to FIG. 2 after a third opening or release step.

In particular the release step according to FIG. 6 illustrates that the guide 31A, 31B extends to a point behind the back side of the fifth mold part 15 in that a portion of the support section 32 movable along the lower base plate 3 is located between the guide 31A, 31B and the fifth mold part 15.

The casting assembly represented in FIGS. 2 to 7 is a so-called two-plate tool. For filling in the metal melt, the second base plate 4 is provided herein with two casting pistons as well as two casting chambers that operate parallel and simultaneously for both casting cavities 1A, 1B.

Figure 2:
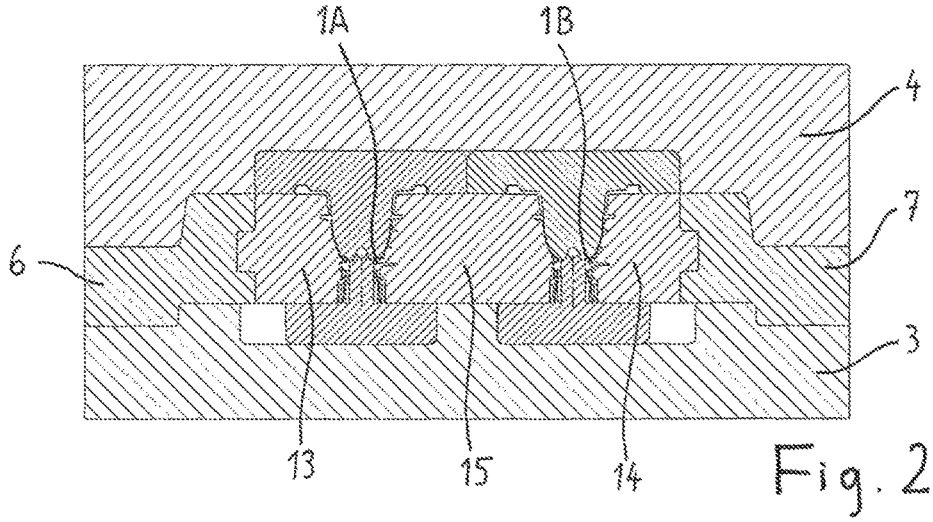
FIG. 2 shows a horizontal section of a second embodiment of the casting mold wherein the casting mold is illustrated prior to casting, i.e., prior to filling in the melt.

FIG. 2 shows the casting assembly prior to filling in the metal melt. The two first mold parts 11A, 11B are in their position of maximum approach relative to each other. Incidentally, all parts of the casting mold are closed.

Figure 3:
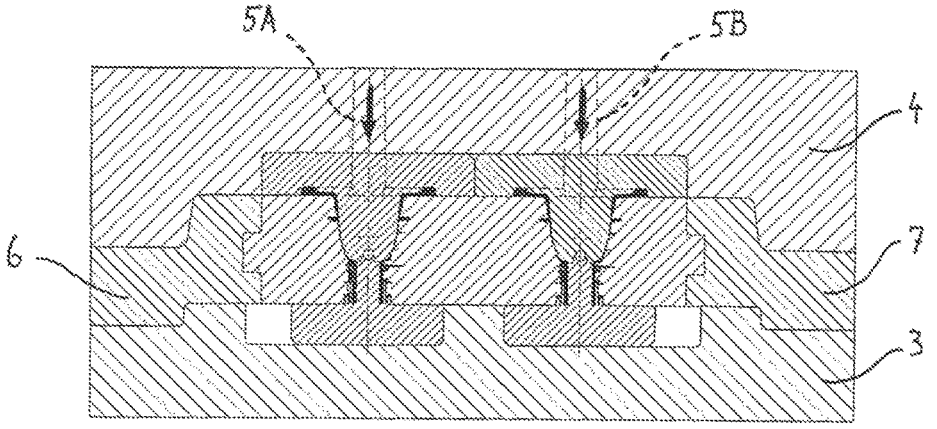
FIG. 3 shows the casting mold according to the second embodiment after casting.

FIG. 3, like FIG. 1, indicates the situation after filling and sufficient solidification of the melt.

FIG. 4 shows in a first release step the separation of the movable first base plate 3 from the second base plate 4. Since the second mold parts 12A, 12B are attached to the second base plate 4, they become detached from the cast parts which are indicated in black. The first release step is carried out by movement of the first base plate 3 in the first release direction D1.

FIG. 5 shows the second release step. In this step, the two lateral parts 6, 7 are moved each laterally in outward direction which is done in the second release direction D2. Accordingly, the third and fourth mold parts 13, 14 that are attached thereto release the respective cast part; this is preferably realized simultaneously.

In FIG. 6, the third release step is illustrated. It is carried out in that a first mold part 11A is moved transversely to the first release direction D1 outwardly while also the other first mold part 11B is moved transversely to the first release direction D1 in outward direction, but oppositely, so that the two first mold parts 11A, 11B are moving apart from each other. In doing so, they are guided along the guide 31A or 31B formed on the first base plate 3. FIG. 6 shows the situation in which the first mold parts 11A, 11B have reached their outer position. They entrain with their mold sections 33 the respective cast part so that the latter becomes detached from the stationary central mold part 15 which is arranged on the first base plate 3.

Figure 7:
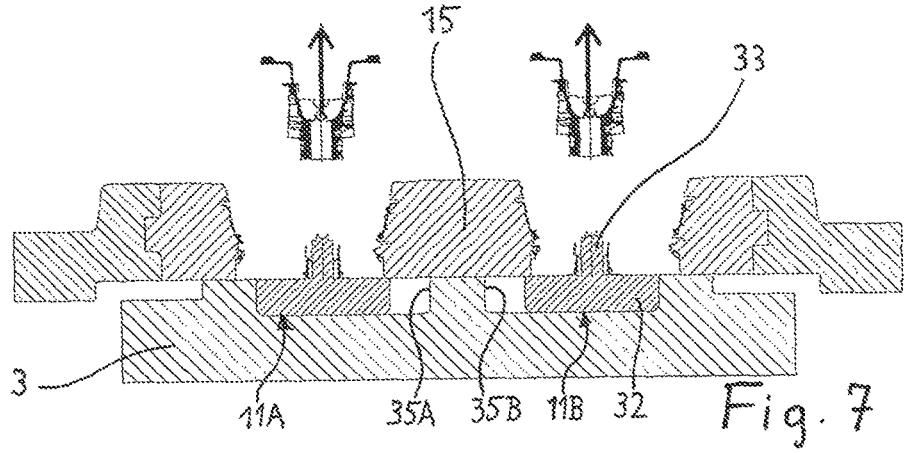
FIG. 7 shows the casting mold according to FIG. 2 after a fourth opening or release step.

Finally, FIG. 7 illustrates the preferably automatic removal of the cast parts from the mold sections 33 of the first mold parts 11A, 11B. This removal is done in the first release direction Dl.

While specific embodiments of the invention have been shown and described in detail to illustrate the inventive principles, it will be understood that the invention may be embodied otherwise without departing from such principles.

LIST OF REFERENCE CHARACTERS

1A casting cavity
1B casting cavity
2 casting mold
3 first base plate, movable plate
4 second base plate, intermediate plate
5 casting chamber
5A casting chamber, channel
5B casting chamber, channel
6 first lateral part
7 second lateral part
8 stationary plate
11A first mold part
11B first mold part
12A second mold part
12B second mold part
13 third mold part

14 fourth mold part
15 fifth mold part
31A guide
31B guide
32 support section
33 mold section
35A stop
35B stop
D1 first release direction
D2 second release direction

What is claimed is:

1. A casting assembly comprising:

a casting mold enclosing at least a first casting cavity and a second casting cavity for casting a cast part each, the casting mold openable in a first release direction and in at least one second release direction that is different from the first release direction, wherein the casting mold comprises:

a first base plate arranged transversely to the first release direction;

first mold parts that determine the configuration of the first and second casting cavities, wherein the first mold parts are supported on the first base plate;

a second base plate arranged opposite the first base plate wherein the first and second casting cavities are located between the first and second base plates;

second mold parts that determine the configuration of the first and second casting cavities, wherein the second mold parts are supported on the second base plate;

a first lateral part arranged between the first and second base plates;

a third mold part that determines the configuration of the first casting cavity and is supported on the first lateral part;

a second lateral part arranged between the first and second base plates;

a fourth mold part that determines the configuration of the second casting cavity and is supported on the second lateral part;

a fifth mold part that determines the configuration of the first and the second casting cavities and is fastened to the first base plate between the first and second casting cavities;

wherein the first and second lateral parts are connected to the first base plate and moveably guided on the first base plate in the at least one second release direction;

wherein the first base plate consists of a single plate having directly formed therein guides that extend in the at least one second release direction;

wherein the first mold parts each comprise a mold section, determining the configuration of the first casting cavity, and further each comprise a support section, wherein only the support sections of the first mold parts are supported on the guides;

wherein the guides extend to a point behind the fifth mold part and a portion of the support sections is located between the guides and the fifth mold part, respectively.

2. The casting assembly according to claim 1, wherein the guides are oriented in the same direction.

3. The casting assembly according to claim 2, wherein the guides are aligned with each other.

4. The casting assembly according to claim 1, wherein the first base plate comprises stops delimiting a movability of the first mold parts in a direction toward each other.

5. The casting assembly according to claim 1, further comprising a stationary plate comprising a common casting chamber for filling in a metal melt, wherein the common casting chamber is branching toward the first and second casting cavities.

6. The casting assembly according to claim 1, wherein, for filling in a metal melt, the second base plate comprises a first casting chamber connected to the first casting cavity and further comprises a second casting chamber connected to the second casting cavity.

* * * * *